US005676809A

United States Patent [19]

Billman

[11] Patent Number: 5,676,809

[45] Date of Patent: Oct. 14, 1997

[54] VESSEL ARRANGEMENT FOR ELECTROPLATING DIES FOR PRODUCING OF INFORMATION-CARRYING DISKS

[75] Inventor: Ake Billman, Jarfalla, Sweden

[73] Assignee: Toolex Alpha AB, Sundbyberg, Sweden

[21] Appl. No.: 378,609

[22] Filed: Jan. 26, 1995

[30] Foreign Application Priority Data

Jan. 26, 1994 [SE] Sweden ..... 9400235

[51] Int. Cl.[6] ..... C24D 17/00

[52] U.S. Cl. ..... 204/278

[58] Field of Search ..... 204/278, 266; 205/94, 68

[56] References Cited

U.S. PATENT DOCUMENTS 4,391,694 7/1983 Runsten ..... 205/68

FOREIGN PATENT DOCUMENTS

| | | |
|---|---|---|
| 495 775 | 4/1930 | Sweden . |
| 944 343 | 6/1956 | Sweden . |
| 420 576 | 10/1981 | Sweden . |
| 465 130 | 7/1991 | Sweden . |
| 336378 | 4/1972 | U.S.S.R. . |

*Primary Examiner*—John Niebling
*Assistant Examiner*—Brendan Mee
*Attorney, Agent, or Firm*—Young & Thompson

[57] ABSTRACT

The invention relates to a vessel arrangement for electroplating dies for production of information-carrying disks. The vessel (14) has a large number of gas extraction openings (34) located in a U-shaped manner around the periphery of the vessel opening (20) and in wall parts of the vessel, which lie close to the opening of the vessel and under a lid (16) covering this opening.

5 Claims, 2 Drawing Sheets

VESSEL ARRANGEMENT FOR ELECTROPLATING DIES FOR PRODUCING OF INFORMATION-CARRYING DISKS

The present invention relates to a vessel arrangement for electroplating dies for production of information-carrying disks, such as compact disks and video disks, which vessel is arranged to contain an electrolyte bath, in which an anode is located and in which a die, which constitutes a cathode, can be immersed, the vessel having an upper opening which can be closed by means of a lid, in addition to which the vessel has a large number of gas extraction openings located at the periphery of the vessel opening and in wall parts of the vessel, which lie close to the opening of the vessel and under the lid, the gas extraction openings communicating with a collecting chamber which is arranged on the outside of the vessel and from which gases and vapors situated above the electrolyte bath can be conducted off via the extraction openings to a gas outlet line coordinated with an evacuation fan.

In the electroplating of dies which are to be used for production of, for example, compact disks and video disks, unhealthy vapors are produced during the process above the electrolyte bath in the plating vessel. When, after plating is completed, the lid over the plating vessel is raised for removal of the plated die, the operator may be exposed to the vapors, even if there is a ventilation installation in the room, with the purpose of conducting the vapors, which have flowed up from the vessel, away from the working area of the operator.

One object of the present invention is to provide a very effective arrangement for preventing the electrolyte vapors reaching the operator.

For this object, the arrangement mentioned in the introduction is characterized in that the gas extraction openings as well as the collecting chamber—seen in a plan view of the arrangement—have a configuration which, in an essentially U-shaped manner, surrounds a part of the vessel opening, a central part of the U-configuration connecting side leg parts of the same being situated on a side of the vessel opening facing away from the handler of the arrangement. By these means, it is made possible effectively to extract and evacuate the vapors, which are produced in the bath during the process, from the vessel when the lid is opened without the vapors being allowed the opportunity of flowing out through the upper opening in the vessel and reaching the surrounding area and the operator who is operating the installation. In particular, it is brought about that the bath vapors flow in a direction away from the operator when they are evacuated from the vessel via the gas extraction openings, the risk of the vapors coming into contact with the operator being minimized.

According to a preferred embodiment of the invention, the opening of the vessel has an essentially rectangular shape, said central part of the U-configuration extending over one of the short sides of the vessel opening.

It is expedient to control the evacuation fan in such a manner that it works at low capacity during the plating process, that is to say it maintains a weak underpressure above the liquid surface in the vessel in order in that connection to prevent vapor leaking out to the surrounding area through chinks or gaps in the lid, and that, just after the opening of the lid has been started, it is made to work at high capacity in order effectively to extract all vapors through the outlet line, when the lid is open, and by these means prevent the vapors flowing out uncontrolled to the surrounding area.

The invention is described in greater detail below with reference to attached drawings, in which.

Figure 1:
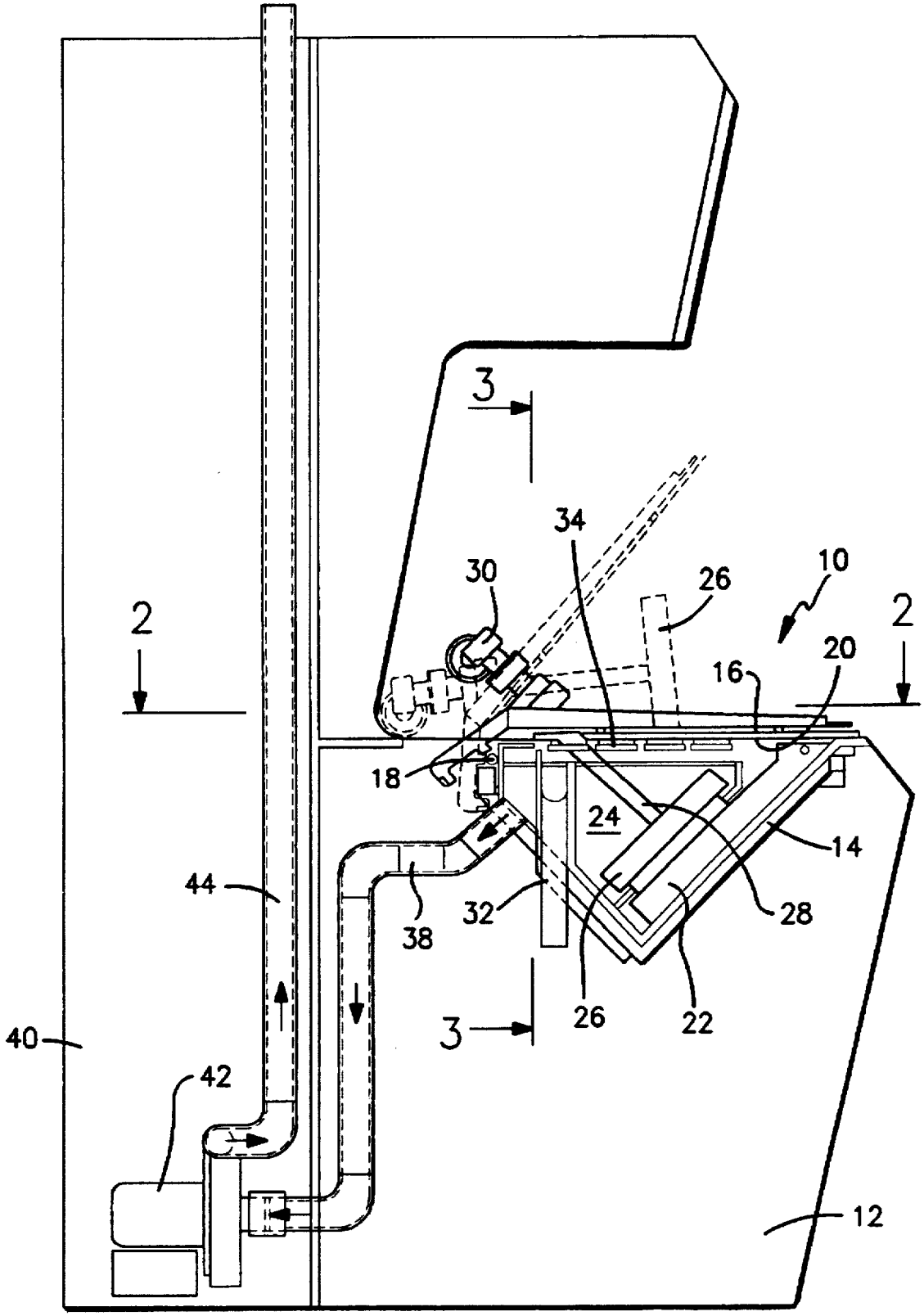
FIG. 1 is a side view of an electroplating installation with a gas evacuation system according to the invention coordinated with an electrolyte vessel.

FIG. 1 shows an installation for plating dies which is generally designated by 10 and intended for production of compact disks and video disks. The installation 10 comprises a lower part 12 which accommodates inter alia a tank (not shown) and a pump unit for supplying a plating vessel 14 with electrolyte liquid. The vessel 14 is supported on the top side of the lower part 12 and is provided with a covering lid 16 which is pivotably mounted about a hinge 18 between a position closing an upper rectangular opening 20 of the vessel 14, such as is shown with solid lines in FIG. 1, and an open position which is shown with broken lines in the same figure. The vessel 14 accommodates in a known manner a stationary anode basket 22 and an electrolyte bath 24, in which a die disk can be immersed, which serves as cathode and is supported by a die holder 26. "Die disk" in this case also means a so-called glass master which has an electrically conducting surface layer of silver and which constitutes the first stage in manufacturing a pressing die. The die holder 26 is also, in a known manner, rotatable with the shaft 28 of a commutator 30 situated on the outside of the lid 16. 32 designates a run-off pipe for the electrolyte bath 24 in the vessel 14, which run-off leads to the tank (not shown).

Figure 2:
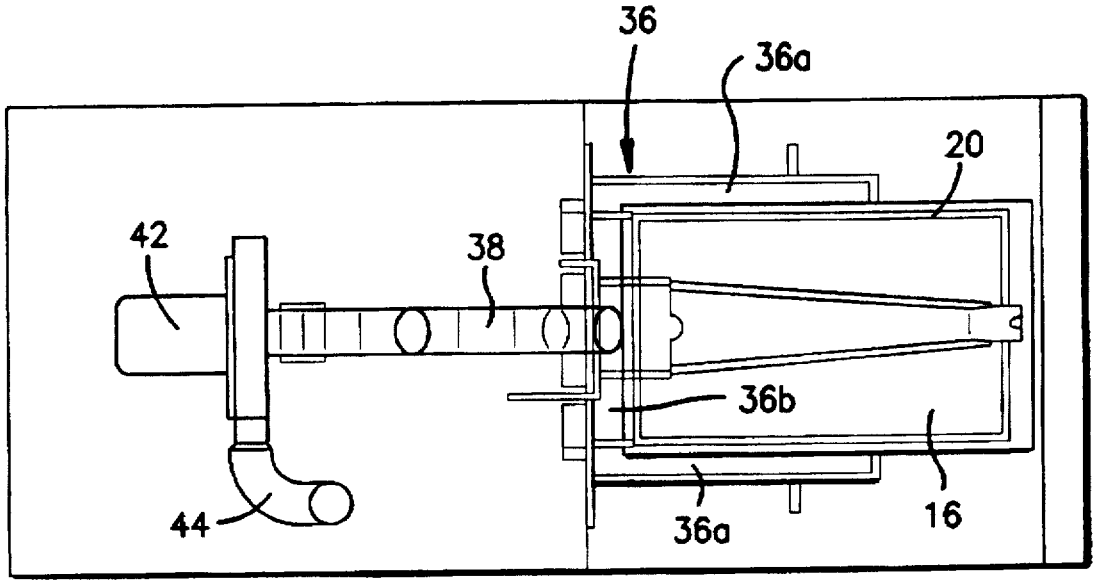
FIG. 2 is a plan view of the vessel according to the section 2—2 in FIG. 1.
Figure 3:
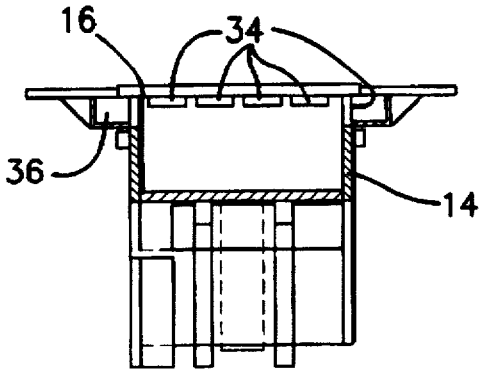
FIG. 3 is a side view of the vessel according to the section 3—3 in FIG. 1.

As is shown best in FIGS. 1 and 3, in the side walls of the vessel 14 there is a large number of vapor extraction openings 34 around a part of the periphery of the vessel opening 20 and on the inside of the lid 16. The extraction openings 34 are in this connection preferably located around the vessel opening 20 in such a manner that they surround this in a U-shaped manner (see FIG. 2) and communicate with a collecting chamber 36 which likewise surrounds the vessel 14 in a U-shaped manner, the web part **36*b* connecting the side legs 36*a* of the U-shaped collecting chamber 36 facing away from the handler of the plating installation 10, that is to say at the further or rear end side of the vessel opening 20**.

In the exemplary embodiment shown, the vapor extraction openings 34 have a horizontal oblong slot shape but can also have another shape which is suitable for the purpose.

Also connected to the web part **36*b* of the collecting chamber 36 is a gas outlet line 38 which leads to an evacuation fan 42 which is mounted in the rear part 40 of the installation and from which a further outlet line 44** starts, which conducts the vapor originating from the electrolyte bath off to the desired place at a distance from the installation.

During operation, when the die disk is submerged in the electrolyte bath 24 and the cover 16 covers the vessel opening 20, as is shown with solid lines in FIG. 1, the fan is arranged to be driven at low speed in order in this case to maintain a small underpressure in the upper part of the vessel and prevent the vapors therein flowing out to the surrounding area through chinks or gaps in the lid. When the plating of the die disk is finished, the lid 16 is first raised a small amount, whereupon the fan 42 is activated to a working state at high capacity during the continued opening movement of the lid and in its open position shown in FIG. 1 with broken lines in order, by means of strong suction action through the suction openings 34, to prevent vapors and gases from the electrolyte bath 24 coming out into the surrounding area of the installation 10, but instead the vapors are extracted by the evacuation fan 42 via the collecting chamber 36 and the outlet lines 38, 44.

I claim:

1. A vessel for electroplating dies for production of information-carrying disks such as compact disks and video disks, said vessel (14) being adapted to contain an electrolyte bath (24), an anode (22) in the vessel (14), the vessel (14) having an upper opening (20), a lid (16) for closing said upper opening, the vessel (14) having a plurality of gas extraction openings (34) located about the periphery of the vessel opening (20) and in wall parts of the vessel (14) which lie close to the opening (20) and under the lid (16), a collecting chamber (36) with which said gas extraction openings (34) communicate, a gas outlet line (38, 44) communicating with said collection chamber (36) , an evacuation fan (42) for moving said gases and vapors through said gas outlet line (38, 44) in a direction away from said collecting chamber (36), extraction openings being arranged in a U-shape only partially surrounding said vessel (14) leaving a side of said vessel free from said extraction openings (34), whereby when an operator using said vessel is located on said side of said vessel, said gases and vapors will be drawn in a direction away from said operator.

2. A vessel as claimed in claim 1, and hinge means (18) by which said lid (16) is vertically swingably connected to said vessel, said hinge means being disposed on a side of said vessel opposite the first-mentioned side of said vessel (14).

3. A vessel as claimed in claim 1, wherein said vessel is rectangular and said collecting chamber (36) extends only partway along two sides of said vessel that adjoin the first-mentioned said side of the vessel.

4. A vessel as claimed in claim 3, wherein said two sides are longer than said first-mentioned side of the vessel (14).

5. A vessel as claimed in claim 1, wherein said fan (42) is driven at high capacity when the lid (16) is raised and is driven at low capacity when the lid (16) is closed.

* * * * *

UNITED STATES PATENT AND TRADEMARK OFFICE

CERTIFICATE OF CORRECTION

PATENT NO. : 5,676,809
DATED : October 14, 1997
INVENTOR(S) : Ake Billman

It is certified that error appears in the above-identified patent and that said Letters Patent is hereby corrected as shown below:

Title page, item [54] and col. 1, line 2, change "producing" to --production--.

Signed and Sealed this

Sixteenth Day of December, 1997

Bruce Lehman

*Attest:*

BRUCE LEHMAN

*Attesting Officer*

*Commissioner of Patents and Trademarks*